US005593060A

United States Patent [19]

Przytulla

[11] Patent Number: 5,593,060

[45] Date of Patent: Jan. 14, 1997

[54] PLASTIC DRUM LID

[75] Inventor: Dietmar Przytulla, Kerpen, Germany

[73] Assignee: Mauser-Werke GmbH, Bruhl, Germany

[21] Appl. No.: 283,695

[22] Filed: Aug. 1, 1994

Related U.S. Application Data

[63] Continuation of Ser. No. 49,722, Apr. 20, 1993, abandoned.

[30] Foreign Application Priority Data

Oct. 28, 1992 [DE] Germany ..... 42 36 338.1

[51] Int. Cl.[6] ..... B65D 45/32

[52] U.S. Cl. ..... 220/319; 206/508; 220/601

[58] Field of Search ..... 220/319, 320, 220/321, 306, 307, 288, 608, 601, 465; 206/508, 509

[56] References Cited

U.S. PATENT DOCUMENTS

| | | | |
|---|---|---|---|
| 2,989,208 | 6/1961 | Gibbs, Jr. . | |
| 3,515,306 | 6/1970 | Roper . | |
| 3,516,571 | 6/1970 | Roper et al. . | |
| 3,531,013 | 9/1970 | Hammes . | |
| 3,664,544 | 5/1972 | Hammes . | |
| 3,696,962 | 10/1972 | Fehres et al. | 220/60 |
| 3,817,420 | 6/1974 | Heisler . | |
| 3,868,041 | 2/1975 | Knize . | |
| 3,955,705 | 5/1976 | Dubois et al. . | |
| 4,117,062 | 9/1978 | Uhlig . | |
| 4,177,934 | 12/1979 | Hammes et al. . | |
| 4,500,010 | 2/1985 | Schutz . | |
| 4,518,097 | 5/1985 | Milton et al. . | |
| 4,674,650 | 6/1987 | Hamilton et al. | 220/319 |
| 4,779,754 | 10/1988 | Ten Eyck et al. | 220/66 |
| 5,033,639 | 7/1991 | Przytulla . | |
| 5,190,157 | 3/1993 | Przytulla . | |
| 5,207,345 | 5/1993 | Stewart et al. . | |
| 5,301,853 | 4/1994 | Addison et al. | 200/320 |

FOREIGN PATENT DOCUMENTS

| | | |
|---|---|---|
| 61-93038 | 5/1986 | Japan . |
| 1275949 | 6/1972 | United Kingdom . |
| WO91/12178 | 8/1991 | WIPO . |

OTHER PUBLICATIONS

Product Reference Guide IPCC International Precision Components Corporation (15 pages).

Mauser–Werke drawing AM–2553 dated Feb. 22, 1991 of prior art CCA drum and lid.

Wavin brochure (2 pages).

*Primary Examiner*—Stephen J. Castellano

*Attorney, Agent, or Firm*—Pennie & Edmonds

[57] ABSTRACT

A plastic drum lid for a standard lidded drum using a clamping member to seal the lid to the drum. The lid includes a central top section of a smaller diameter then the diameter of the lid, with the central section spaced from the rim of the lid by a circumferential groove.

14 Claims, 4 Drawing Sheets

Normal Shape
Deformed Shape

Normal Shape
Deformed Shape

PLASTIC DRUM LID

This is a continuation of application Ser. No. 08/049,722, filed Apr. 20, 1993, now abandoned.

FIELD OF THE INVENTION

The invention relates to a plastic drum lid for providing a liquid-tight connection to a drum.

BACKGROUND OF THE INVENTION

Lidded drums are generally known as including a drum body with an outer wall and an essentially radially protruding casing flange at some distance from the top end of the drum opening. The flange acts as a counter-bearing for a clamping member. The plastic drum lid has a U-shaped lid rim, whose outer rim wall grips over the top of the outer wall of the drum body and as far down as its casing flange. An essentially radially protruding lid flange runs all around the outer rim wall of the lid rim for cooperating with the casing flange. The rim also includes an inner rim wall extending through the drum opening and for a distance, essentially parallel and near to the inside surface of the outer wall of the drum. A sealing ring disposed in the lid rim seals against the top end of the drum opening. When the drum is closed, the clamping member extends over both the casing flange and the lid flange. Such lidded drums are generally known to persons skilled in the art as they are used all over the world. This standard lidded drum, developed by Mauser, is described in the U.S. Pat. No. 4,177,934.

Certain requirements regarding storage and transport safety are imposed on lidded drums. They require testing and verification in special approval tests (e.g. side fall on the casing side, diagonal fall on the lid rim, static inside pressure test, etc.). With previous known plastic lidded drums, the drum lid can become loose under certain conditions, especially in the case of liquid fills. The drum lid can even jump off completely when the drum topples from heights of about 1.20 m, e.g. from the platform of a truck.

SUMMARY OF THE INVENTION

It is the object of the invention to further develop and improve the plastic drum lid for a standard lidded drum, where the lid is made of hard plastic and held on the drum body by means of a ring-shaped clamping member gripping the casing flange and lid flange, in such a fashion that the drum remains liquid-tight even at great fall heights. Drums equipped with the improved lid can be used for hazardous liquids.

In construction, the lid includes a groove between the central lid section and the lid rim. A downwardly extending conical ring-shaped section connects the central lid section to a lower annular flat section which is, in turn, connected to the lid rim to define the groove. Through the conical section considerably greater elasticity is imparted to the drum lid under deformations. The inner wall of the lid rim no longer kinks. Only an inner ring piece which extends axially downwardly from the conical section in a direction parallel to the inner rim wall now retains slight kinking points; but these no longer cause the lid to become unsealed from the drum. Even with a high interior pressure, the central lid section can deform and yield purely elastically over the annular groove and the conical section, without the clamping member being relieved of stress and the drum becoming unsealed.

The special advantage of the inventive drum lid consists in the feature that it fits on all standardized and non-standardized lidded drums. Also, the body of the drum need not be changed or adapted.

The annular flat section of the groove is disposed as deep as possible along the rim, i.e. the annular flat section is connected to the inner wall of the lid rim in the region of the lid flange or of the casing flange. This is an important aspect of the invention in that it reinforces the lower region of the inner wall of the lid. The inner wall of the lid is thus prevented from bending up or yielding when the clamping member is relieved of pressure; and the kinking stiffness in the radial plane is considerably improved. Since the annular flat section is disposed at a distance below the central lid section, it is itself not stiffened, but, on the contrary, can better deform elastically and yield if the drum topples or strikes the ground. Because the lid is more flexible in the center section, which is generally flat, and because the stiffness of the lid rim is simultaneously increased, the lid flange is kinked less strongly in its lateral bending areas, e.g., in case of a lateral impact on casing drop. Consequently, the tendency of the lid to pull its lid flange out of the over-gripping clamping member is significantly reduced. The annular flat section is directed radially and should be at least 10 mm wide, preferably about 20 mm wide.

The inner, axially directed ring piece of the lid, which extends into the drum almost as deeply as the inner wall of the lid, is also important. This inner ring piece provides additional stability when there is interior pressure. During a pressure test (1 bar) for over 30 minutes, a customary lid with the top central section of the lid attached at the inner rim wall bulges outwardly and at the same time causes the inner rim wall to shift to a slanted or conical position. Thus, the clamping member is relieved of stress and the drum lid becomes loose.

With the inventive drum lid, the inner ring piece reduces the deformation of the inner wall of the lid rim, due to its stiffness, and thus increases the tightness of the drum. In case of a dropping of the drum, the inner ring piece dampens and distributes the maximum stress peaks which occur in the lateral bending areas of the drum, thereby also avoiding or reducing a slant position of the inner rim wall of the lid.

BRIEF DESCRIPTION OF THE DRAWINGS

The invention is explained and described in more detail below by way of the embodiments shown in the drawings of which:

In FIG. 1, the reference number 1 designates a liquid-tight lidded drum of thermoplastic with a capacity of e.g. 220 l. A drum lid 2 constructed in accordance wit the teachings of the present invention is clamped in a gas and liquid-tight manner on the outer body wall 3 of the drum body by means of a ring-shaped clamping member 4.

FIG. 2 shows in partial section the customary, known, plastic drum lid 5 for the standard lidded drum which is used worldwide, here with a thin plastic inliner 6 (foil bag). A circumferential, solid casing flange 7 protrudes essentially radially from the outer body wall 3 of the drum at a distance (about 40 to 50 mm) from the top end 8. The known drum lid 5 has a U-shaped lid rim 9, open towards the bottom. The rim is located at the periphery of the central flat lid disc section 10. A sealing ring 11 is inserted between the outer rim wall 12 and the inner rim wall 13 of the rim. The outer rim wall 12 covers the outer body wall 3 of the drum as far down as the casing flange 7, and the inner rim wall 13 of the lid rim extends for a way (about 40 mm) into the opening of the drum body, as defined by the upper end 8 of the outer body wall 3, in a manner that is essentially parallel to and near or flush with the inner surface of the outer wall. A circumferential lid flange 14 protrudes essentially radially from the outer wall of the lid rim at its lower end. When the lidded drum 1 is closed, the clamping member 4 grips over this lid flange and under the casing flange 7 as a counter-bearing. At the same time, the sealing ring 11 is pressed on the top end 8 of the outer body wall 3 of the drum so as to act as a seal against gases and liquids.

Figure 2:
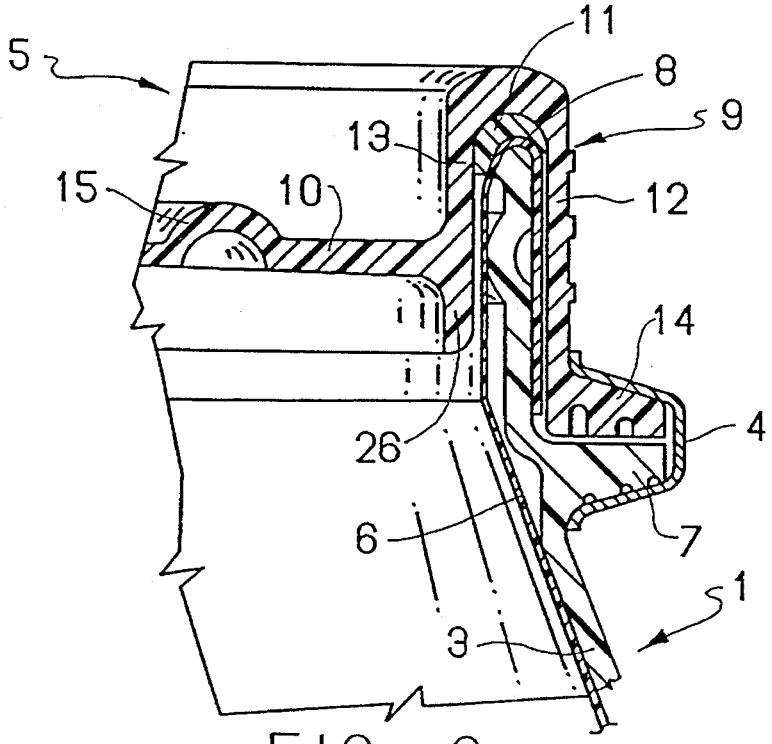
FIG. 2 Prior Art
FIG. 2 is a partial section through the upper right hand corner of a known standard lidded drum with inliner.

In the known construction of FIG. 2, the central flat disc section 10 of the lid includes a surrounding ring bead elevation 15 at a radial distance from the lid rim. When several drums are stacked on one another, the elevation 15 serves to center or to radially fix the bottom of the stacked drum.

During approval tests, packing containers such as bung drums (without separate lids) and lidded drums must pass certain fall tests, so that they can be used to transport environmentally hazardous materials, especially hazardous liquids. These tests include, for example, lateral fall on the side of the drum, diagonal fall on the lid edge, a static interior pressure test at 1 bar over-pressure, and other tests.

Figure 3:
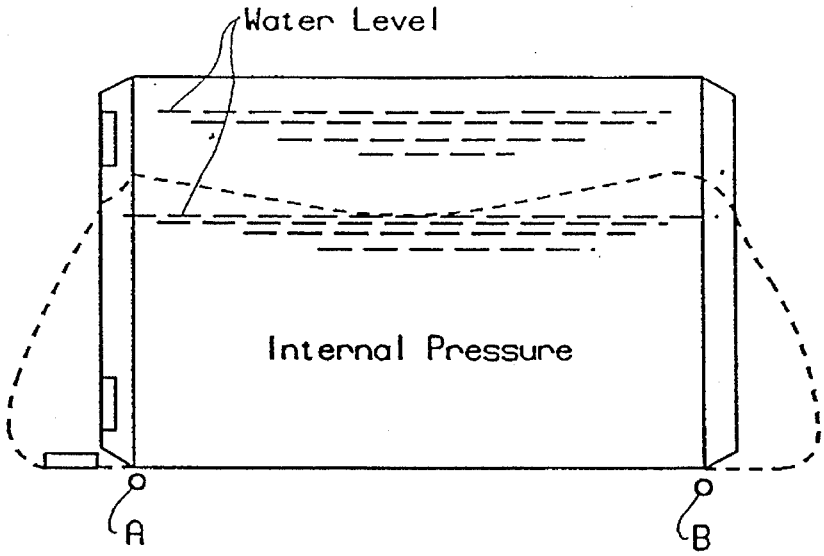
FIG. 3 is a schematic representation showing the results of dropping (side impact) of a plastic bung or lidded drum filled with liquid.
Figure 4:
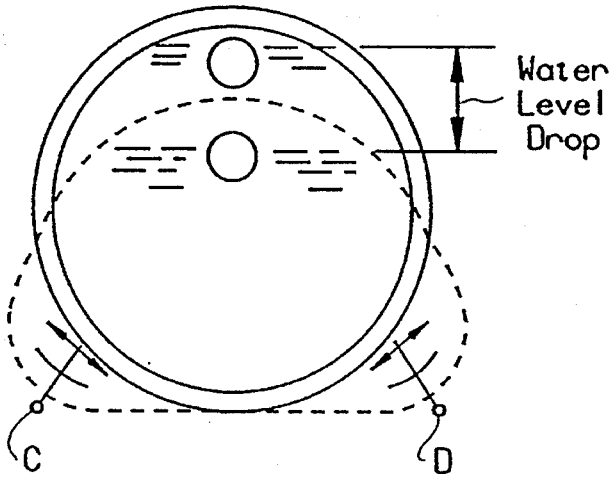
FIG. 4 is a schematic representation showing the front of the drum of FIG. 3.

FIG. 3 schematically shows the classical side fall of a plastic bung or lidded drum in a side view, and FIG. 4 shows this in a front view. At the instant that the drum strikes the ground, the drum body and the drum top are extremely deformed elastically. Looking in the axial direction (FIG. 3), the greatest deformations occur in the regions about the points A and B, and, looking in the radial direction (FIG. 4), they occur in the regions about the points C and D.

In the case of a lidded drum, the clamping ring and the lid rim are especially over-stressed at the points C and D, so that permanent plastic deformations often remain at these points after a drum falls. Thus the drum and lid become loose with respect to each other and useless for further use. In particular, in the case of hazardous fill materials, a severe danger then exists for the environment. This is reliably avoided if the body of the standard lidded drum is provided with the drum lid constructed according to the teachings of the present invention.

Figure 1:
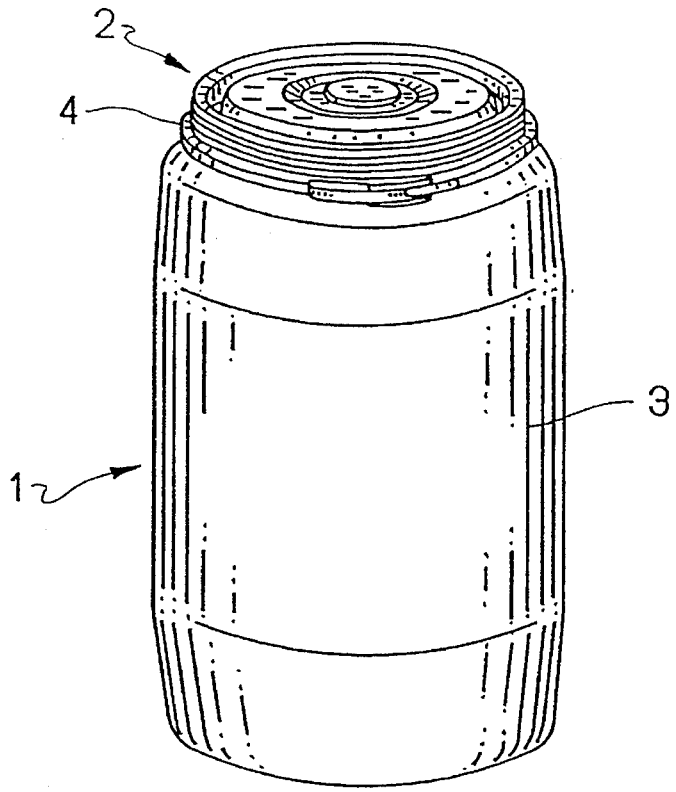
FIG. 1 is a perspective view showing the body of a standard lidded drum and clamping ring with a drum lid of the present invention.
Figure 5:
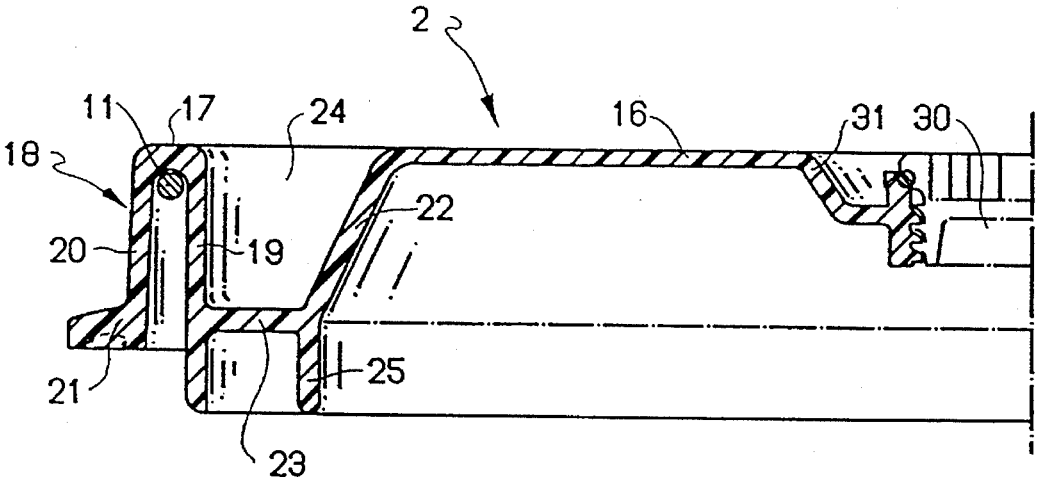
FIG. 5 is a cross-sectional view of one side of the preferred embodiment of an inventive drum lid of the present invention.

The drum lid 2 of the present invention consists of a stiff high density polyethylene (HD-PE) plastic and is fabricated by injection molding. As shown in FIGS. 1 and 5, the central top of the lid is defined by a flat central section 16 of a reduced diameter less than the diameter of the lid. The central section 16 is located at a height essentially flush with and in about the same plane as the upper end 17 of the lid rim 18.

The lid rim 18 includes an inner rim wall 19 and an outer rim wall 20. The lid rim also includes a lid flange 21 which extends radially outwardly from the outer wall 20 of the rim. The inner rim wall 19 of the lid rim extends deeply into the drum body and is constructed longer than the outer rim wall 20.

The central section 16 of the lid is connected at its peripheral edge to a downwardly extending first section 22. In the embodiment of FIG. 5, this section is conical and is spaced at some distance from the lid rim 18. As shown in FIG. 5, the conical section 22 is designed so as to run downwardly at a slant of about 25°. In principle, the section 22 can also be designed almost cylindrically.

The lower end of the conical section 22, preferably in the region of the rim flange 21 or the casing flange 7 is connected to the radial inner end of an annular horizontal second section 23. Section 23 extends radially between the conical section 22 and the inner rim wall 19 to which it is connected at its outer radial end. This construction forms an annular, circumferential deep groove 24 (about 20 to 40 mm deep) between the central section 16 and the inner wall 19 of the lid rim.

The annular section 23 extends essentially at right angles (or at a slight slant) from the inner rim wall 19 of the lid rim. For a favorable deformation behavior when the drum topples, the annular section 23 is connected to the inner rim wall 19 of the lid rim in the region of the lid flange 21 or of the casing flange 7. For drum lids of lidded drums with a capacity of e.g. 30, 60, 120, 150 or 220 l it is suitable for the annular section 23 to extend radially between 5 mm and 50 mm, preferably about 20 mm, depending on the capacity of the lidded drum.

In order to make the drum lid extremely stiff radially, the inner rim wall 19 of the lid rim extends as far as the lower edge of the casing flange 7. Here, the annular section 23 is disposed at a distance of at least 10 mm from the lower end of the inner rim wall 19, and the conically progressing section 22, which connects to the annular section 23, has at its lower end, an essentially cylindrical inner ring piece 25 as an extension, on the inside of the drum lid. As a result of this, the area between the conical section 22 and the inner rim wall 19 of the lid rim is reinforced in the manner of an inverted U-shaped support.

Figure 6:
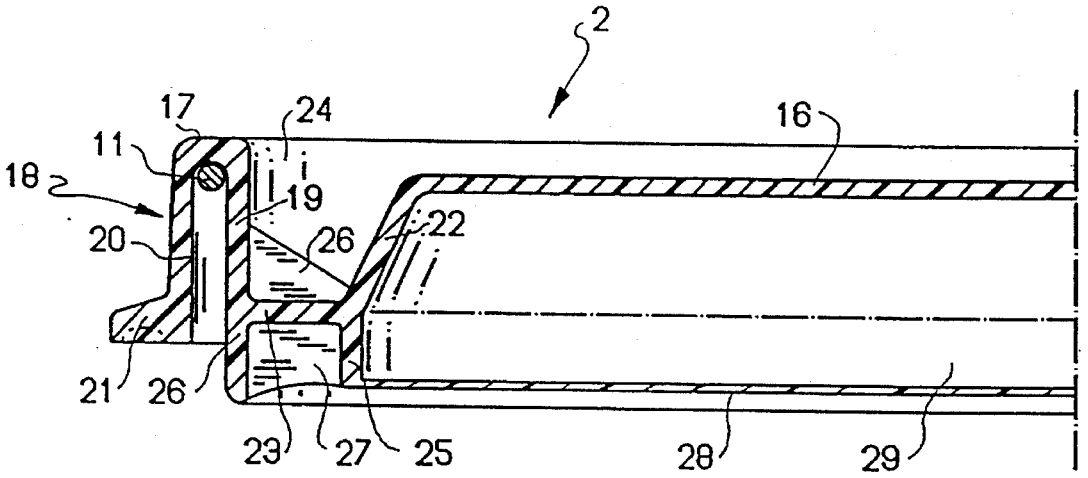
FIG. 6 is a view similar to FIG. 5 showing another embodiment of the invention.

FIG. 6 shows another embodiment of the invention, in which the upper surface of the central section 16 is disposed lower and below the level of the upper end 17 of the lid rim 18, so as to radially fix a stacked second drum. Above the annular section 23 and within the groove 24 as well as below the annular section, a large number of uniformly spaced radially directed (star-shaped) reinforcement ribs 26 (top) and 27 (bottom) are formed. These ribs extend between the inner rim wall 19 of the lid rim and the conical section 22 and its inner extension ring piece 25.

With special lid designs, a thin plastic foil 28, preferably consisting of about 0.5 mm to 1 mm thick polyethylene PE, can be provided at the inner ring piece 25 or at the lower surface of the annular section 23 (FIG. 7), so that a closed lid space 29 is formed between the plastic foil 28 and the central section 16 of the lid. This closed lid space 29 and the gas cushion enclosed therein serve as a shock absorber (energy consumption) for the shock-like surge pressure which occurs when a drum topples, and thus provide protection against excessive deformation of the lid.

In another modified construction of the lid, the plastic foil 28 is welded on as a stable plastic disk with a thickness of about 2 to 3 mm. The closed lid space 29 can then be used to receive another different fill material or inert medium. A small closable bung hole opening is then suitably provided eccentrically in the central section 16 of the lid.

Figure 7:
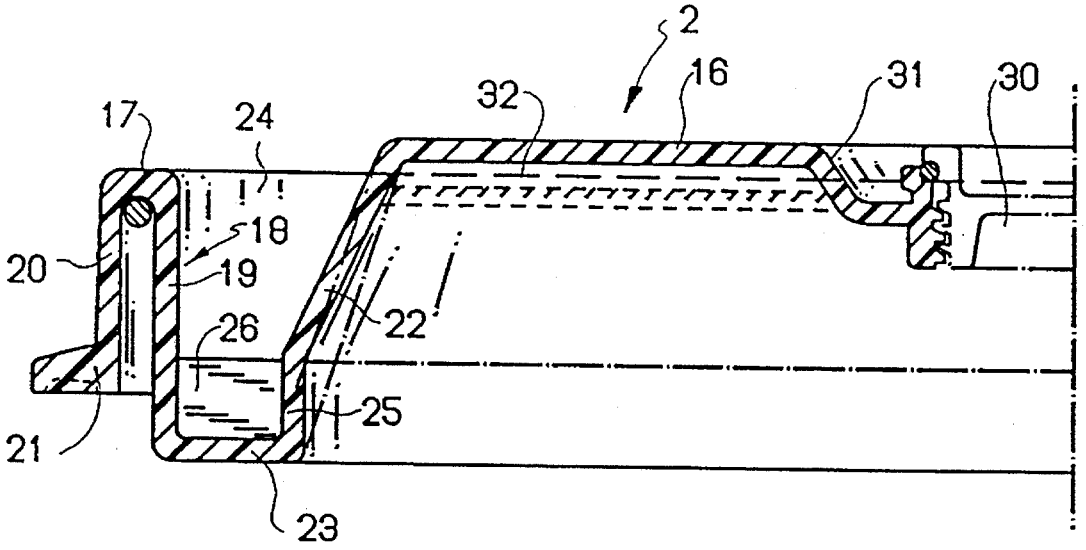
FIG. 7 is a view similar to FIG. 5 showing a further embodiment of the invention.

FIG. 7 shows another embodiment of the invention where the surface of the flat central section 16 is disposed at a level higher than the level of the upper top end 17 of the lid rim 18, by some distance, e.g., one to three times the thickness of about 4 to 5 mm of the central section 16 of the lid. This construction permits the build-up of a supportive hydrostatic over-pressure in the interior of the drum when several filled drums are stacked on one another.

The central section of the drum lid can also be provided with a large, closable bung hole opening 30, which is gas-tight and liquid-tight, and which is disposed centrally, preferably in a recessed bung housing 31 which is drawn in deeper towards the inside and toward the bottom of the drum. A bung hole connection piece for the bung opening 30 can also be designed so as to be elongated toward the inside of the drum. With this construction, the plastic disk forming the lid space 29 is additionally welded to the bung hole connection piece. Thus, the connection piece is formed so as to penetrate through the lid space 29 with an interior opening located in the interior of the drum. This special modification can be provided, e.g., to receive a second fill material (two-component adhesive with adhesive in the drum body and hardener in the drum lid) or the lid space can contain a special fill material (inert material), which is released into the interior of the drum during an extreme fall (deliberate design rupture point), and which can neutralize and render harmless a hazardous or toxic fill material.

If the drum lid is provided with a bung opening 30, disposed in a recessed bung housing 31, it is suitable to provide at least one radial drainage channel 32. This channel 32, which is shown in the embodiment of FIG. 7, is formed downwardly in the central section 16 and extends through the conical section 22, so as to drain out rain water which may possibly collect in the bung housing 31. To reinforce the central section 16 further, several of these radial channels 32 can be formed so as to emanate from the bung housing 31 and empty into the outer ring groove 24. With the bottom of the channel 32 being higher than the top end 17 of the lid rim, the bung housing 31 will drain dry.

Another feature of the lid of the present invention shown in FIG. 7 is that the annular section 23 connects at its radial outer end to the lower end of the inner rim wall 19 and at its radial inner end to the lower end of the conical section 22 (as shown in phantom lines in FIG. 7) or its extension ring part piece 25 (as shown in solid lines if FIG. 7). This creates, inside the drum lid, a smooth surface for inserting an inliner 44 (foil bag) or a lid inliner.

The individual features presented in the various embodiments can be combined with one another.

Drop tests, including a drop on the drum wall (side fall) and on the lid rim (diagonal fall), have been performed with a normal 120 l standard drum body and the inventive drum lid according to FIG. 5. In such tests, the lid was of a stiff HD-PE plastic material with a 9 mm thick sponge rubber sealing ring and a clamping member of a material thickness (steel sheet) of 1.75 mm was used to clamp the lid to the drum body. When the drum was dropped from a height of 1.80 m and 2 m (water as fill medium), the drum lids remained tight. Even with a drop height of 2.50 m, the drum lids did not burst from the drum body. During the hydraulic interior pressure test (fill medium water, 1 bar over 30 minutes), the drums remained completely liquid-tight.

Cold tests at −20° C. (cold fall) with a fill material of 225 kg sand or a water/glycol mixture likewise yielded better results than the same drop test with the previously used drum lids.

I claim:

1. In a plastic drum lid (2) for a liquid-tight lidded drum (1) having a drum body with an outer body wall (3) ending in a top end (8) to define a drum opening, the lid having a central lid section (16), a lid rim (18) with an inner rim wall (19) and an upper end (17) surrounding the central section (16) for engaging with the body wall (3) to close the opening defined by the top end (8), thereof, and a clamping region at which the lid is to be clamped to said drum, the improvement comprising:

a) the central lid section (16) is spaced radially inwardly from said lid rim (18);

b) said lid (2) further includes a first conical section (22) disposed along the periphery of said central section (16) and extending downwardly and radially outwardly from said central section (16) to define an annular circumferential groove (24) between the central section (16) and the inner rim wall (19);

c) the first section (22) extends downwardly to a first lower end;

d) a second annular section (23) is connected between said lower end of the first section (22) and the inner rim wall (19);

e) the second annular section (23) is spaced below said central section and extends substantially at a right angle from the inner rim wall (19) of the lid rim;

f) the inner rim wall (19) extends downwardly to define a lower end portion disposed below the second annular section (23);

g) an inner ring piece (25) extends downwardly from the lower end of the first section (22) in spaced relation to the inner rim wall (19) to define, with the second annular section (23) and the lower end portion of said inner rim wall (19), a reinforced, inverted U-shaped support; and h) the second annular section (23) is connected to the inner rim wall (19) of the lid rim at a height level no higher than the clamping region of said lid.

2. The drum lid of claim 1, wherein the inner rim wall (19) of the lid rim is at least as long as the outer rim wall (20) of the lid rim.

3. In a plastic drum lid (2) for a liquid-tight lidded drum (1) having a drum body with an outer body wall (3) ending in a top end (8) to define a drum opening, and an outwardly protruding casing flange (7) on the body wall (3) at a spaced distance from the top end (8) of the body wall (3) for providing a counter-bearing surface for a ring-shaped clamping member (4), the lid (2) having a central lid section (16), a U-shaped lid rim (18), having an outer rim wall (20) for griping over the outer wall surface of the body wall (3) from the top end (8) to the casing flange (7), and an inner rim wall (19) for extending through the drum opening and into the drum body and along the inside wall surface of the body wall (3), a lid flange (21) protruding outwardly from the outer rim wall (20) of the lid defining a clamping region for seating against the casing flange (7) of the drum with the clamping member (4) extending over both the casing flange (7) and the lid flange (21) to clamp the lid to the drum, the improvement comprising:

a) the central lid section (16) is spaced radially inwardly from said inner rim wall (19) and is disposed at a height above said lid flange (21);

b) said lid further includes a first section (22) disposed along the periphery of said central section (16) and extending downwardly therefrom to define an annular circumferential groove (24) between the central section (16) and the inner rim wall (19);

c) the first section (22) extends downwardly to a first lower end;

d) a second annular section (23) is connected between said lower end of the first section (22) and the inner rim wall (19);

e) the first section (22) is conical and extends downwardly and radially outwardly from the central section (16) to the second annular section (23);

f) the inner rim wall (19) of the lid rim (18) is at least as long as the outer rim wall (20) of the lid rim;

g) the second annular section (23) is spaced below said central section and extends substantially at a right angle from the inner rim wall (19) of the lid rim;

h) the inner rim wall (19) extends downwardly to define a lower end portion disposed below the second annular section (23);

i) an inner ring piece (25) extends downwardly from the lower end of the first section (22) in spaced relation to the inner rim wall (19) to define, with the second annular section (23) and the lower end portion of said inner rim wall (19), a reinforced, inverted U-shaped support; and j) the second annular section (23) is connected to the inner rim wall (19) of the lid rim at a height level no higher than the clamping region of said lid.

4. The drum lid of claim 3, further including a bung-hole opening (30) in the central section (16) of the lid, and a recessed bung housing (31) extending downwardly in said central section (16) with said bung hole opening being deposed in the housing.

5. The drum lid of claim 4, further including at least one radial extending channel (32) in the central lid section (16) extending radially from said bung housing (31) to said groove (24).

6. The drum lid of either one of claims 1 and 3, wherein the second annular section (23) is connected to the inner rim wall (19) of the lid rim at the height level of the clamping region of said lid when the lid is sealed to the drum.

7. The drum lid of either one of claims 1 and 3, wherein several uniformly, circumferentially spaced, regularly extending reinforcement ribs (27) are disposed below the second annular section and connected between the inner rim wall (19) and the ring piece (25).

8. The drum lid of either one of claims 1 and 3, wherein several uniformly, circumferentially spaced, regularly extending reinforcement ribs (26) are disposed above the second annular section (23) within the groove (24) and connected between the inner rim wall (19) of the lid rim and the first section (22).

9. The drum lid of either one of claims 1 and 3, wherein the central section (16) has an upper surface which is substantially flat and disposed at the same height level as the upper end (17) of the drum lid rim (18), to provide a stacking surface when several drums are stacked on one another.

10. The drum lid of either one of claims 1 and 3, wherein central section (16) has an upper surface which is disposed below the upper end (17) of the lid rim (18) to provide for radially fixing of a stacked second drum.

11. The drum lid of either one of claims 1 and 3, wherein the central section (16) has an upper surface which is disposed above the upper end (17) of the lid rim (18) in order to build up a supporting inside pressure in the drum interior when several filled drums are stacked on one another.

12. The drum lid of either one of claims 1 and 3, further including a thin plastic foil (28) extending across the lid at the lower end of the inner ring piece (25) to define a closed lid space (29) between the plastic foil (28) and the central section (16).

13. The drum lid of either one of claims 1 and 3, wherein the radial extent of the second annular section (23) is about 20 mm.

14. The drum lid of either one of claims 1 and 3, wherein the lid is constructed of stiff high density polyethylene.

* * * * *